US007135432B2

(12) United States Patent
Whitcomb et al.

(10) Patent No.: US 7,135,432 B2
(45) Date of Patent: Nov. 14, 2006

(54) DIRECT THERMOGRAPHIC MATERIALS WITH PHENOLIC REDUCING AGENTS

(75) Inventors: David R. Whitcomb, Woodbury, MN (US); Leif P. Olson, Rochester, NY (US); Peter J. Cowdery-Corvan, Webster, NY (US); Kumars Sakizadeh, Woodbury, MN (US); Takuzo Ishida, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 154 days.

(21) Appl. No.: 11/012,788

(22) Filed: Dec. 15, 2004

(65) Prior Publication Data

US 2006/0128566 A1 Jun. 15, 2006

(51) Int. Cl.
*B41M 5/30* (2006.01)

(52) U.S. Cl. ..... 503/212; 427/150

(58) Field of Classification Search ..... 503/201, 503/212

See application file for complete search history.

(56) References Cited

U.S. PATENT DOCUMENTS

| | | | |
|---|---|---|---|
| 3,031,329 | A | 4/1962 | Wingert |
| 5,527,758 | A | 6/1996 | Uyttendaele et al. |
| 5,582,953 | A | 12/1996 | Uyttendaele et al. |
| 5,922,528 | A | 7/1999 | Weaver et al. |
| 6,093,528 | A | 7/2000 | Terrell et al. |
| 6,211,115 | B1 | 4/2001 | Loccufier et al. |
| 6,337,303 | B1 | 1/2002 | Dooms et al. |
| 6,693,062 | B1 | 2/2004 | Dooms et al. |

*Primary Examiner*—B. Hamilton Hess
(74) *Attorney, Agent, or Firm*—J. Larry Tucker; Louis M. Leichter

(57) ABSTRACT

Non-photosensitive direct thermographic materials comprise a reducing agent that is a specific ortho-amino-phenol, para-amino-phenol, or hydroquinone compound. These compounds can reduce silver(I) ion to metallic silver to produce a dense black silver image under the short time and high temperature conditions that occur when using thermal print-heads during direct thermal printing. The materials are characterized by their calculated aqueous deprotonation and their calculated anion HOMO energies.

22 Claims, No Drawings

DIRECT THERMOGRAPHIC MATERIALS WITH PHENOLIC REDUCING AGENTS

FIELD OF THE INVENTION

This invention relates to non-photosensitive direct thermographic materials having unique reducing agents ("developers") as part of the imaging chemistry. The invention also relates to methods of imaging such direct thermographic materials.

BACKGROUND OF THE INVENTION

Silver-containing direct thermographic imaging materials are non-photosensitive materials that are used in a recording process wherein images are generated by the direct application of thermal energy. These materials have been known in the art for many years and generally comprise a support having disposed thereon one or more imaging layers comprising (a) a relatively or completely non-photosensitive source of reducible silver ions, (b) a reducing agent composition (acting as a developer) for the reducible silver ions, and (c) a suitable hydrophilic or hydrophobic binder. Thermographic materials are sometimes called "direct thermal" materials in the art because they are directly imaged by a source of thermal energy without any transfer of the energy or image to another material.

In a typical thermographic construction, the image-forming layers are based on silver salts of long chain fatty acids. The preferred non-photo-sensitive reducible silver source is a silver salt of a long chain aliphatic carboxylic acid having from 10 to 30 carbon atoms, such as behenic acid or mixtures of acids of similar molecular weight. At elevated temperatures, the silver of the silver carboxylate is reduced by a reducing agent whereby a black-and-white image of elemental silver is formed.

Problem to be Solved

Direct thermographic materials are imaged by a recording process wherein images are generated by imagewise heating a recording material containing chemical components that change color or optical density in an imagewise fashion. The chemical components include the reducing agent noted above. Many compounds have been described in the art that are considered useful for this purpose. They are often phenolic compounds having at least one hydroxy substituent as described, for example, in U.S. Pat. No. 5,582,953 (Uyttendaele et al.) and U.S. Pat. No. 6,093,528 (Terrell et al.).

The phenolic reducing agents of the prior art have varying usefulness, and vary in their light stability, resistance to aerial oxidation, tint and/or tone of the silver image, and ability to produce a dense black metallic silver image under the short time and high temperature conditions that occur during thermal printing. Thus, there remains a continuing need to provide reducing agents for direct thermographic materials that generate a dense black metallic silver image with a thermal print-head.

SUMMARY OF THE INVENTION

The present invention provides a black and white non-photosensitive direct thermographic material comprising a support and on one or both sides thereof, one or more thermally sensitive imaging layers having in reactive association, a non-photosensitive source of reducible silver ions and an ortho-amino-phenol, para-amino-phenol, or hydroquinone compound reducing agent for the reducible silver ions, wherein the ortho-amino phenol compounds have a calculated aqueous deprotonation energy of less than 307 kcal/mol and a calculated anion HOMO energy more negative than −4.17 eV, the para-amino phenol compounds have a calculated aqueous deprotonation energy of less than 310 kcal/mol and a calculated anion HOMO energy more negative than −4.18 eV, and the hydroquinones have a calculated aqueous deprotonation energy of less than 311 kcal/mol and a calculated anion HOMO energy more negative than −4.06 eV.

The present invention also provides a method comprising imaging the direct thermographic material of the present invention with a thermal imaging source (such as thermal print-head) to provide a visible image.

Where the direct thermographic material comprises a transparent support, the image-forming method can further comprise:

positioning the imaged thermographic material with the visible image thereon between a source of imaging radiation and an imageable material that is sensitive to the imaging radiation, and thereafter exposing the imageable material to the imaging radiation through the visible image in the imaged thermographic material to provide an image in the imageable material.

The method of this invention can be used to provide a visible image useful for medical diagnostic purposes.

The present invention provides direct thermographic materials that contain novel reducing agents that produce a dense black silver image under the short time and high temperature conditions that occur when using thermal print-heads during thermal printing.

DETAILED DESCRIPTION OF THE INVENTION

The direct thermographic materials can be used to provide black-and-white images using non-photosensitive silver salts, specific reducing agents, binders, and other components known to be useful in such materials.

The direct thermographic materials can be used in black-and-white thermography and in electronically generated black-and-white hardcopy recording. They can be used as output media, in radiographic imaging (for example digital medical imaging), X-ray radiography, and in industrial radiography. Furthermore, the absorbance of these thermographic materials between 350 and 450 nm is desirably low (less than 0.5), to permit their use in the graphic arts area (for example, in imagesetting and phototypesetting operations), in the manufacture of printing plates, in contact printing, in duplicating ("duping"), and in proofing.

The direct thermographic materials are particularly useful as output media for medical imaging of human or animal subjects in response to visible or X-radiation. Such applications include, but are not limited to, thoracic imaging, mammography, dental imaging, orthopedic imaging, general medical radiography, therapeutic radiography, veterinary radiography, and auto-radiography.

In the direct thermographic materials, the components needed for imaging can be in one or more thermally sensitive layers on one side ("frontside") of the support. The layer(s) that contain the non-photosensitive source of reducible silver ions, or both, are referred to herein as thermographic emulsion layer(s) or thermally sensitive imaging layer(s).

Where the materials contain thermographic imaging layers on one side of the support only, various non-imaging layers can be disposed on the "backside" (non-emulsion or non-imaging side) of the materials, primer layers, interlayers, opacifying layers, subbing layers, carrier layers, auxiliary layers and/or conductive layers. Particularly important non-imaging layers include an outermost protective layer.

In such embodiments, various non-imaging layers can also be disposed on the "frontside," imaging, or emulsion side of the support, including primer layers, interlayers, opacifying layers, subbing layers, carrier layers, auxiliary layers, and other layers readily apparent to one skilled in the art.

For some embodiments, the direct thermographic materials may be "double-sided" and have thermographic emulsion coating(s) or thermally sensitive imaging layer(s) on both sides of the support. In such constructions each side can also include one or more primer layers, interlayers, antistatic layers, auxiliary layers, anti-crossover layers, conductive layers, and other layers readily apparent to one skilled in the art. An outermost protective layer can be on either or both sides of the support.

Definitions

As used herein:

In the descriptions of the thermographic materials, "a" or "an" component refers to "at least one" of that component (for example, the phenolic reducing agents described below).

"Thermographic material(s)" means a construction comprising at least one thermographic emulsion layer or thermally sensitive imaging layer(s) wherein the source of reducible silver ions is in one layer and the other essential components or desirable additives are distributed, as desired, in the same layer or in an adjacent coating layer, as well as any supports, protective overcoat layers, image-receiving layers, carrier layers, blocking layers, conductive layers, subbing or priming layers. These materials have at least one protective layer as described herein. These materials also include multilayer constructions in which one or more imaging components are in different layers, but are in "reactive association." For example, one layer can include the non-photosensitive source of reducible silver ions and another layer can include the reducing agent, but the two reactive components are in reactive association with each other. Such embodiments also include an outermost protective layer over all thermally sensitive layers.

Also, unless otherwise indicated, the terms "thermographic material" and "direct thermographic materials" are meant to refer to embodiments of the present invention.

When used in thermography, the term, "imagewise exposing" or "imagewise exposure" means that the material is imaged using any means that provides an image using heat. This includes, for example, analog exposure where an image is formed by differential contact heating through a mask using a thermal blanket or infrared heat source, as well as by digital exposure where the image is formed one pixel at a time such as by modulation of thermal print-heads or by thermally imaging with a modulated scanning laser beam. The materials used herein are direct thermographic materials that are imaged using a digital exposure.

The materials of this invention are "direct" thermographic materials and thermal imaging is carried out in a single thermographic material containing all of the necessary imaging chemistry. Direct thermal imaging is distinguishable from what is known in the art as thermal transfer imaging (such as dye transfer imaging) in which the image is produced in one material ("donor") and transferred to another material ("receiver") using thermal means.

"Catalytic proximity" or "reactive association" means that the reactive components are in the same layer or in adjacent layers so that they readily come into contact with each other during thermal imaging and development.

"Emulsion layer," "imaging layer," or "thermographic emulsion layer," means a thermally sensitive layer of a thermographic material that contains the non-photosensitive source of reducible silver ions. It can also mean a layer of the thermographic material that contains, in addition to the non-photosensitive source of reducible ions, additional desirable components. These layers are usually on what is known as the "frontside" of the support.

The protective layer is the outermost layer on the imaging side of the material that is in direct contact with the imaging means.

Many of the chemical components used herein are provided as a solution. The term "active ingredient" means the amount or the percentage of the desired material contained in a sample. All amounts listed herein are the amount of active ingredient added unless otherwise specified.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive. The direct thermographic materials of the present invention are non-photosensitive meaning that no photosensitive silver halide(s) has been purposely added.

The sensitometric terms, absorbance, contrast, Dmin, and Dmax have conventional definitions known in the imaging arts. In thermographic materials, Dmin is considered herein as image density in the areas with the minimum application of heat by the thermal print-head. The sensitometric term absorbance is another term for optical density (OD).

Image tone is defined by the known CIELAB color system (Commission Internationale de l'Eclairage) as discussed in detail in *Principles of Color Technology*, $2^{nd}$ Ed., Billmeyer and Saltzman, John Wiley & Sons, 1981. In this color system, color space is defined in terms of L*, a*, and b* wherein L* is a measure of the chroma or brightness of a given color, a* is a measure of the red-green contribution, and b* is a measure of the yellow-blue contribution. In a two-dimension plot of a* versus b*, a more negative a* provides a greener tone and a more negative b* provides a bluer ("colder") tone. Conversely, a more positive a* provides a more reddish tone and a more positive b* provides a more yellowish ("warmer") tone. Neutral tone is defined wherein a* and b* are both zero. As optical density increases, a* and b* tend toward zero, because the darker an image appears, the more difficult it is to distinguish color in the image, and thus, the more neutral it appears. Image tone a* and b* values can be measured using conventional methods and equipment, such as a HunterLab UltraScan Colorimeter.

Another tone parameter is h(ab), or hue angle, that is equal to arctan(b*/a*), as measured at an optical density of 1.0, and as defined in the CIELAB color system.

"Transparent" means capable of transmitting visible light or imaging radiation without appreciable scattering or absorption.

The phrase "organic silver coordinating ligand" refers to an organic molecule capable of forming a bond with a silver atom. Although the compounds so formed are technically silver coordination complexes or silver compounds they are also often referred to as silver salts.

The terms "double-sided," "double-faced coating," and "duplitized" are used to define thermographic materials having one or more of the same or different thermally sensitive layers disposed on both sides (frontside and backside) of the support.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl").

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group can include ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. A skilled artisan would exclude substituents that adversely react with other active ingredients as not being inert or harmless.

Research Disclosure (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

Non-Photosensitive Source of Reducible Silver Ions

The non-photosensitive source of reducible silver ions used in the direct thermographic materials can be any silver-organic compound that contains reducible silver(I) ions. Such compounds are generally silver salts of silver coordinating ligands. Preferably, it is an organic silver salt that is comparatively stable to light and forms a silver image when heated to 50° C. or higher in the presence of a reducing agent. Mixtures of the same or different types of silver salts can be used if desired.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, silver behenate is used alone or in mixtures with other silver salts.

In some embodiments, a highly crystalline silver behenate can be used as part or all of the non-photosensitive sources of reducible silver ions, as described in U.S. Pat. No. 6,096,486 (Emmers et al.) and U.S. Pat. No. 6,159,667 (Emmers et al.), both incorporated herein by reference. Moreover, the silver behenate can be used in its one or more crystallographic phases (such as a mixture of phases I, II and/or III) as described in U.S. Pat. No. 6,677,274 (Geuens et al.) that is incorporated herein by reference.

Other useful but less preferred silver salts include but are not limited to, silver salts of aromatic carboxylic acids and other carboxylic acid group-containing compounds, silver salts of aliphatic carboxylic acids containing a thioether group as described in U.S. Pat. No. 3,330,663 (Weyde et al.), silver carboxylates comprising hydrocarbon chains incorporating ether or thioether linkages, or sterically hindered substitution in the α- (on a hydrocarbon group) or ortho- (on an aromatic group) position, as described in U.S. Pat. No. 5,491,059 (Whitcomb), silver salts of aliphatic, aromatic, or heterocyclic dicarboxylic acids, silver salts of sulfonates as described in U.S. Pat. No. 4,504,575 (Lee), silver salts of sulfosuccinates as described in EP 0 227 141 A1 (Leenders et al.), silver salts of acetylenes as described in U.S. Pat. No. 4,761,361 (Ozaki et al.) and U.S. Pat. No. 4,775,613 (Hirai et al.), silver salts of compounds containing mercapto or thione groups and derivatives thereof (such as those having a heterocyclic nucleus containing 5 or 6 atoms in the ring, at least one of which is a nitrogen atom), as described in U.S. Pat. No. 4,123,274 (Knight et al.) and U.S. Pat. No. 3,785,830 (Sullivan et al.), silver salts of mercapto or thione substituted compounds that do not contain a heterocyclic nucleus, silver salts of compounds containing an imino group (such as silver salts of benzotriazole and substituted derivatives thereof), silver salts of 1,2,4-triazoles or 1-H-tetrazoles as described in U.S. Pat. No. 4,220,709 (deMauriac), and silver salts of imidazoles and imidazole derivatives as described in U.S. Pat. No. 4,260,677 (Winslow et al.).

It is also convenient to use silver half soaps that are blends of silver carboxylates and carboxylic acids.

The methods used for making silver soap emulsions are well known in the art and are disclosed in *Research Disclosure,* April 1983, item 22812, *Research Disclosure,* October 1983, item 23419, U.S. Pat. No. 3,985,565 (Gabrielsen et al.), and the references cited above.

Non-photosensitive sources of reducible silver ions can also be provided as core-shell silver salts such as those described in U.S. Pat. No. 6,355,408 (Whitcomb et al.), that is incorporated herein by reference, or as silver dimer compounds that comprise two different silver salts as described in U.S. Pat. No. 6,472,131 (Whitcomb), that is also incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,803,177 (Bokhonov et al.) that is incorporated herein by reference.

The one or more non-photosensitive sources of reducible silver ions are preferably present in an amount of from about 5% to about 70% (more preferably, from about 10% to about 50%), based on the total dry weight of the emulsion layers. Stated another way, the amount of the sources of reducible silver ions is generally present in an amount of from about 0.001 to about 0.2 mol/m$^2$ of the thermographic material, and preferably from about 0.005 to about 0.05 mol/m$^2$ of that material.

Reducing Agents

The phenolic reducing agents useful in the present invention comprise certain ortho-amino-phenol, para-amino-phenol, and hydroquinone (that is, para-hydroxy-phenol) compounds that can reduce silver(I) ion to metallic silver to produce a dense black silver image under the short time and high temperature conditions that occur when using thermal print-heads during thermal printing.

It was found that the useful reducing agents can be defined by ranges of parameters that can be evaluated computationally. These parameters are related to the experimentally well-known properties of acidity and oxidation potential of the reducing agent, however for computational purposes they are conveniently estimated instead as the aqueous deprotonation energy (ADE) and the highest occupied molecular orbital (HOMO) energy, more specifically the HOMO energy of the species derived from deprotonation of the reducing agent, referred to herein as the "anion HOMO energy". Computation of these parameters using the well-known B3LYP theoretical method and the well-known 6-31G* theoretical level is described later in this section. Due to the nature of theoretical chemistry, some variation is expected in the obtained values, depending on the theoretical method and theoretical level, so the procedure is explained in some detail.

The ortho-amino phenol compounds have a calculated aqueous deprotonation energy of less than 307 kcal/mol and preferably less than 305 kcal/mol along with a calculated-anion HOMO energy more negative than −4.17 eV and preferably more negative than −4.34 eV.

The para-amino phenol compounds have a calculated aqueous deprotonation energy of less than 310 kcal/mol and preferably less than 309 kcal/mol along with a calculated anion HOMO energy more negative than −4.18 eV.

The hydroquinones have a calculated aqueous deprotonation energy of less than 311 kcal/mol and preferably less than 303 kcal/mol along with a calculated anion HOMO energy more negative than −4.06 eV and preferably more negative than −4.28 eV.

The procedure used to determine the deprotonation energies and anion HOMO energies of the reducing agents involves the following series of steps:

(1) Theoretically predict the lowest-energy conformation of the reducing agent, in its deprotonated form and its non-deprotonated form. There are numerous methods of conformational energy searching that can be used to predict low-energy conformations. Such conformational energy search methods most commonly vary the torsion angles of the single bonds of a molecular model (usually with the exception of conformationally unimportant rotations, such as methyl groups), then do a geometry optimization of a given conformation, after which the calculated structure and energy (or relative energy) of the resulting refined structure is stored. After a certain number of conformations have been evaluated in this way, the lowest-energy conformation can be identified. The process of varying the conformations, refining the structures, and evaluating the energy of the resulting structures can be done in a number of ways, for example procedures involving random sampling ("Monte Carlo" methods), systematic sampling of all reasonable conformations, "rule-based" procedures to sample conformations, molecular dynamics calculations, or some combination of such procedures. Some of these procedures are described in A. K. Rappe, C. J. Casewit, *Molecular Mechanics Across Chemistry,* University Science Publishers, (Herndon, Va.), 1997. As will be appreciated by those skilled in the art of computational chemistry, the approach taken will usually vary with the size of the molecule and the number of conformationally distinct single bond torsions that must be evaluated, and it is possible that molecules with many such single bond torsions (perhaps 10 or more) will be prohibitively large for the lowest energy conformation to be known with certainty, or there may be more than one nearly equivalent energy conformation that must be reevaluated with more accurate levels of theory to determine which conformation is the lowest in energy. It has been found that among the most important features to be varied are the intramolecular hydrogen bonds, if any, and if there is more than one ionizable proton in the structure, to evaluate the relative energies of isomeric structures bearing the same molecular charge and with varied positions of the protons (for example, tautomers). Structural refinement and energy evaluations of trial structures may be done in a number of ways, for example force field methods as described in *Molecular Mechanics Across Chemistry,* or semi-empirical, ab initio, or density functional theory methods as described in Levine, I. N. *Quantum Chemistry,* 5$^{th}$ Edition, Prentice-Hall, 1999.

For the phenolic reducing agents evaluated for this invention, a systematic search using the standard PM3 semi-empirical method (described in J. J. P. Steward, *J. Comp. Chem.* 1989, 10, 221) was used for theoretically predicting the lowest energy conformations. The software used for performing the systematic searches was "SPARTAN® '02", a commercially available computer program from Wavefunction Incorporated (Irvine, Calif.), but the PM3 method is available in many other software programs.

(2) The second step is further refinement of the structures from the previous step using a more accurate theoretical method. There are many levels of theory that might be chosen to accomplish this, but for the present work, a standard B3LYP density functional method (A. D. Becke, *J. Chem. Phys.* 1993, 98, 5648) was used, with the standard 6-31G* basis set (P. C. Hariharan and J. A. Pople, *Theor Chim. Acta* 1973, 28, 213, M. M. Francl, W. J. Pietro, W. J. Hehre, J. S. Binkley, M. S. Gordon, D. J. DeFrees, and J. A. Pople, *J. Chem. Phys.* 1982, 77, 3654). The B3LYP/6-31G* theoretical method was used to re-optimize the lowest energy structures of the reducing agents in their deprotonated and non-deprotonated forms. The B3LYP/6-31G* method is available in ab initio software programs, including JAGUAR, version 4.1 or 5.0 (Schrodinger Inc., Portland, Oreg.), GAUSSIAN-98 (Gaussian Inc., Carnegie, Pa.), and GAMESS (Iowa State University, Ames, Iowa). For elements for which the 6-31G* basis set is not available, the LACVP* basis set (P. J. Hay and W. R. Wadt, *J. Chem. Phys.* 1985, 82, 270, W. R. Wadt and P. J. Hay,

*J. Chem. Phys.* 1985, 82, 284, and P. J. Hay and W. R. Wadt, *J. Chem. Phys.* 1985, 82, 299) may be substituted. Standard gradient routines available in the programs can be used for structure optimizations.

(3) Perform single-point B3LYP/6-31G* solvation calculations, with the geometries of the deprotonated and non-deprotonated reducing agent obtained in the previous step, using the self-consistent reaction field model as described in D. J. Tannor, B. Marten, R. B. Murphy, R. A. Friesner, D. Sitkoff, A. Nicholls, M. N. Ringnalda, W. A. Goddard III, B. Honig, *J. Am. Chem. Soc.* 1994, 116, 11875, and in B. Marten, K. Kim, C. Cortis, R. A. Friesner, R. B. Murphy, M. N. Ringnalda, D. Sitkoff, D., and B. Honig, *J. Phys. Chem.* 1996, 100, 11775. The ab initio calculations for deprotonation energy were carried out using "JAGUAR®", (versions 4.1 and 5.0), a commercially available ab initio computer program available from Schrodinger, Inc. (Portland, Oreg.). Arbitrarily, the solvent chosen is water. As in the previous step, for elements for which the 6-31G* basis set is not available, the LACVP* basis set may be substituted.

(4) Examine the results of the solvation calculations done in the previous step. The quantities of interest are the solution phase energies of the deprotonated and non-deprotonated reducing agents, and the HOMO energy of the deprotonated reducing agent. From this are determined two figures of merit. The first figure of merit is the difference between the solution phase energy of the non-deprotonated and deprotonated reducing agent, converted to units of kcal/mol. The second figure of merit is the HOMO energy of the deprotonated reducing agent, converted to units of eV.

By "calculated anion HOMO energy" is meant the computed energy level of the highest occupied molecular orbital (using the B3LYP/6-31G* method corrected for water solvation, in this case using the solvent model as implemented in JAGUAR version 4.1 or 5.0 software) of the deprotonated phenolic reducing agent as described above. It is recognized that the actual charge of the deprotonated reducing agent might not always be negative, as implied by the term "anion HOMO", because of intramolecular proton translocation (tautomers), substitution by charge-neutralizing groups (perhaps resulting in zwitterions), and the like, however this refers to structures with one or more phenolic oxygens that are substantially anionic, as a result of having no direct attachment to a proton. By "direct attachment to a proton" is meant an O—H distance of 1.25 Ångstroms (0.125 nm) or less in the B3LYP/6-31G* calculated structure, and does not refer to hydrogen bonds that may be formed by the phenolic oxygen.

A consequence of the parameters included in the calculations to determine the aqueous deprotonation energy and anion HOMO energy of the ortho-amino-phenol, para-amino-phenol, and hydroquinone compounds, is that they appear to require at least one electron-withdrawing group on the benzene ring. By "electron-withdrawing," we mean monovalent radicals that when positioned on a benzene ring, have a positive Hammett-sigma (σ) value. Hammett-sigma values are standard values used to predict the electron withdrawing or electron donating effect of substituents on phenyl rings. Such values are known for many substituents [for example, see J. March, *Advanced Organic Chemistry: Reactions, Mechanisms, and Structure,* McGraw-Hill Book Company, New York, pp. 238–241, (1968) and C. Hansch et al., *Substituent Constants for Correlation Analysis in Chemistry,* John Wiley & Sons, New York, (1979)]. In addition, they can be calculated using standard procedures as described for example in M. S. Newman, *Steric Effects in Organic Chemistry,* John Wiley & Sons, Inc., pp. 570–574, 1956, and in *Progress in Physical Organic Chemistry,* vol. 2, Interscience Publishers, pp. 333–339, 1964.

Thus, the preferred ortho-amino-phenol, para-amino-phenol, and hydroquinone compounds can be represented by the following structures (I), (II), and (III):

(I)

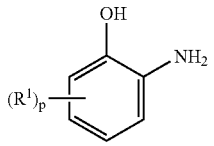

(II)

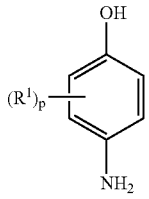

(III)

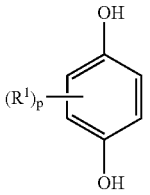

wherein $R^1$ represents the same or different electron-withdrawing groups and p is 1 or 2.

Representative substituent groups that are sufficiently electron withdrawing include, but are not limited to, alkylcarbonyl and arylcarbonyl, alkyl and aryl sulfonyl (such as methylsulfonyl, trifluoromethyl sulfonyl, and phenylsulfonyl), alkyl and aryl sulfoxide, alkyl and aryl imino, alkyl and aryl carboxamido, nitro, nitroso, alkyl and aryl aminosulfonyl (such as methyl and phenyl aminosulfonyl), cyano, carboxy, carboxylic acid, perhaloalkyl (such as trichloromethyl and trifluoromethyl), alkoxycarbonyl and aryloxycarbonyl groups (such as methoxycarbonyl and phenoxycarbonyl), quaternary ammonium, (such as trimethylammonium), and halo groups (such as fluoro, chloro, and bromo). Other useful $R^1$ groups within this definition would be readily understood by one skilled in the art. The preferred electron withdrawing groups are cyano, nitro, trichloromethyl, and bromo.

The following compounds (RA-1) to (RA-17) are representative of phenolic compounds useful in the present invention:

(RA-1)

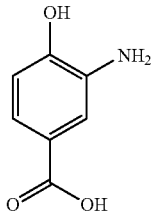

-continued
(RA-2)
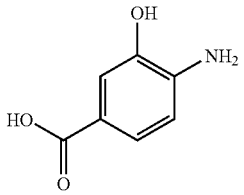
(RA-3)
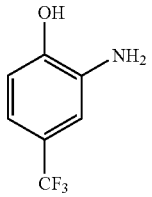
(RA-4)
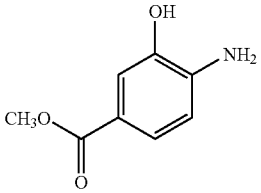
(RA-5)
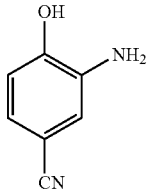
(RA-6)
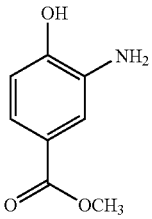
(RA-7)
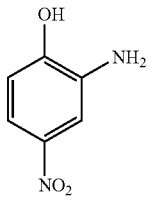
(RA-8)
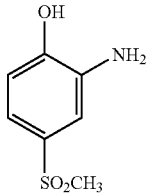
(RA-9)
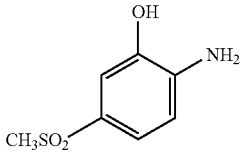
-continued
(RA-10)
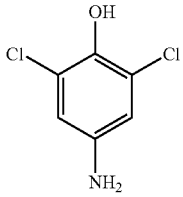
(RA-11)
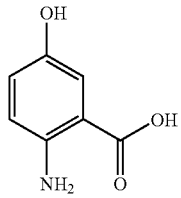
(RA-12)
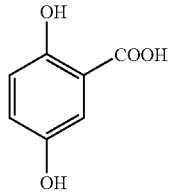
(RA-13)
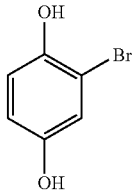
(RA-14)
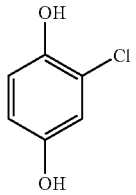
(RA-15)
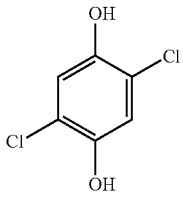
(RA-16)
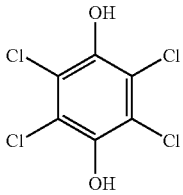

-continued (RA-17)

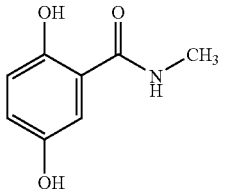

The phenolic reducing agents described herein are present in an amount of at least 0.03 mol/mol of total silver. Preferably, they are present in an amount of from about 0.05 to about 2.0 mol/mol of total silver.

The phenols useful in this invention can be obtained from several commercial sources such as Aldrich Chemical Company, or prepared using known starting materials and methods known in the art.

Other Addenda

The direct thermographic materials can also contain other additives such as toners, shelf-life stabilizers, contrast enhancers, dyes or pigments, post-processing stabilizers or stabilizer precursors, thermal solvents (also known as melt formers), and other image-modifying agents as would be readily apparent to one skilled in the art.

Suitable stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having-$SO_2CBr_3$ groups as described in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during imaging can also be used, as described in U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzo-triazoles may be used as stabilizing compounds as described in U.S. Pat. No. 6,171,767 (Kong et al.).

The direct thermographic materials may also include one or more thermal solvents (or melt formers). Combinations of these compounds can also be used including a combination of succinimide and dimethylurea. Known thermal solvents are disclosed in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

"Toners" or derivatives thereof that improve the image are highly desirable components of the thermographic materials. These compounds, when added to the imaging layer, shift the color of the image from yellowish-orange to brown-black or blue-black. Generally, one or more toners described herein are present in an amount of from about 0.01% to about 10% (more preferably from about 0.1 % to about 10%), based on the total dry weight of the layer in which it is included. Toners may be incorporated in the thermographic emulsion layer or in an adjacent non-imaging layer.

Compounds useful as toners are described in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Additional useful toners are substituted and unsubstituted mercaptotriazoles as described in U.S. Pat. No. 3,832,186 (Masuda et al.), U.S. Pat. No. 6,165,704 (Miyake et al.), U.S. Pat. No. 5,149,620 (Simpson et al.), U.S. Pat. No. 6,713,240 (Lynch et al.), and U.S. Patent Application Publication 2004/0013984 (Lynch et al.), all of which are incorporated herein by reference.

Phthalazine and phthalazine derivatives [such as those described in U.S. Pat. No. 6,146,822 (Asanuma et al.), incorporated herein by reference], phthalazinone, and phthalazinone derivatives are particularly useful toners.

Toners particularly useful in aqueous-coated systems include the phthalazine compounds described in U.S. Pat. No. 6,605,418 (Ramsden et al.), the triazine thione compounds described in U.S. Pat. No. 6,703,191 (Lynch et al.), and the heterocyclic disulfide compounds described in U.S. Pat. No. 6,737,227 (Lynch et al.), all of which are incorporated herein by reference.

The thermographic materials can also include one or more image stabilizing compounds that are usually incorporated in a "backside" layer. Such compounds can include phthalazinone and its derivatives, pyridazine and its derivatives, benzoxazine and benzoxazine derivatives, benzothiazine-dione and its derivatives, and quinazoline-dione and its derivatives, particularly as described in U.S. Pat. No. 6,599,685 (Kong). Other useful backside image stabilizers include anthracene compounds, coumarin compounds, benzophenone compounds, benzotriazole compounds, naphthalic acid imide compounds, pyrazoline compounds, or compounds described in U.S. Pat. No. 6,465,162 (Kong et al.) and GB 1,565,043 (Fuji Photo).

The thermographic materials may also include one or more polycarboxylic acids and/or anhydrides thereof that are in thermal working relationship with the sources of reducible silver ions in the one or more thermally sensitive imaging layers. Such polycarboxylic acids can be substituted or unsubstituted aliphatic (such as glutaric acid and adipic acid) or aromatic compounds and can be present in an amount of at least 5 mol % ratio to silver. They can be used in anhydride or partially esterified form as long as two free carboxylic acids remain in the molecule. Useful polycarboxylic acids are described for example in U.S. Pat. No. 6,096,486 (noted above).

Binders

The non-photosensitive source of reducible silver ions, the reducing agent composition, toners, and any other imaging layer additives are generally combined with one or more binders that are generally hydrophobic or hydrophilic in nature. Thus, either aqueous or organic solvent-based formulations can be used to prepare the photothermographic materials. Mixtures of either or both types of binders can also be used.

Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable hydrophobic binders are polyvinyl butyral resins that are available under the names BUTVAR® (Solutia, Inc., St. Louis, Mo.) and PIOLOFORM® (Wacker Chemical Company, Adrian, Mich.).

Hydrophilic binders or water-dispersible polymeric latex polymers can also be present in the formulations. Examples of useful hydrophilic binders include, but are not limited to, proteins and protein derivatives, gelatin and gelatin-like derivatives (hardened or unhardened), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides and other synthetic or naturally occurring vehicles commonly known for use in aqueous-based photographic emulsions (see for example, *Research Disclosure,* item 38957, noted above). Cationic starches can also be used as a peptizer for tabular silver halide grains as described in U.S. Pat. No. 5,620,840 (Maskasky) and U.S. Pat. No. 5,667,955 (Maskasky).

Water-dispersible hydrophobic polymers that are provided as polymer latexes can also be used as binders in minor amounts in the thermographic materials of this invention. Such materials are well known in the art including U.S. Pat. No. 6,096,486 (noted above).

Hardeners for various binders may be present if desired. Useful hardeners are well known and include diisocyanate compounds as described in EP 0 600 586 B1 (Philip, Jr. et al.), vinyl sulfone compounds as described in U.S. Pat. No. 6,143,487 (Philip, Jr. et al.) and EP 0 640 589 A1 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process,* Fourth Edition, Eastman Kodak Company, Rochester, N.Y., 1977, Chapter 2, pp. 77–8.

Where the proportions and activities of the photothermographic materials require a particular developing time and temperature, the binder(s) should be able to withstand those conditions. When a hydrophobic binder is used, it is preferred that the binder (or mixture thereof) does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. Preferably, a binder is used at a level of from about 10% to about 90% by weight (more preferably at a level of from about 20% to about 70% by weight) based on the total dry weight of the layer.

It is particularly useful in the direct thermographic materials to use predominantly (more than 50% by weight of total binder weight) hydrophobic binders in both imaging and non-imaging layers on both sides of the support. In particular, the outermost layers are generally formulated and disposed on the support with one or more hydrophobic binders such as cellulose ester polymer binders. Of these binders, cellulose nitrate, cellulose acetate, cellulose acetate butyrate, and cellulose acetate propionate are preferred.

Support Materials

The direct thermographic materials comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal imaging and development and to have suitable adhesive properties with overlying layers. Useful polymeric materials for making such supports include polyesters, cellulose acetate and other cellulose esters, polyvinyl acetal, polyolefins, polycarbonates, and polystyrenes. Preferred supports are composed of polyesters or polycarbonates, such as polyethylene terephthalate film.

Opaque supports can also be used, such as dyed polymeric films and resin-coated papers that are stable to high temperatures. Support materials can contain various colorants, pigments, and dyes if desired. For example, the support can contain conventional blue dyes that differ in absorbance from colorants in the various frontside or backside layers as described in U.S. Pat. No. 6,248,442 (Van Achere et al.). Support materials may be treated using conventional procedures (such as corona discharge) to improve adhesion of overlying layers, or subbing or other adhesion-promoting layers can be used.

Protective Layer

The direct thermographic materials can have an outermost protective layer on at least the imaging side of the support. A wide variety of materials are useful as binders or other components in such outermost layers as described in U.S. Pat. No. 5,536,696 (Horsten et al.), U.S. Pat. No. 5,817,598 (DeFieuw et al.), and U.S. Pat. No. 6,313,065 (Horsten et al.). Such protective layers can include matte agents (organic or inorganic particles), "slip" agents, lubricants, pigments, reinforcing agents, antistatic agents, conductive agents, coating aids, and tinting agents.

In preferred embodiments of this invention, the thermographic materials comprise an outermost protective layer on the imaging side that comprises two or more specific lubricants from designated classes of compounds. The protective layer provides both protective and transport (or "slip") properties. Such protective layers and their methods of preparation are described in copending and commonly assigned U.S. Ser. No. 10/767,757 (filed Jan. 28, 2004 by Kenney, Foster, and Johnson) incorporated herein by reference.

More particularly, the protective layer can comprise:

(a) one or more solid polymers, each derived from one or more olefins and from one or more ethylenically unsaturated polymerizable carboxylic acids or esters or anhydrides thereof, (b) one or more branched (x-olefin polymers, and (c) optionally, one or more additional waxes.

Preferably, all three components (a), (b), and (c) are present in the protective layer.

Component (a) is a solid polymer derived from one or more olefins and from one or more ethylenically unsaturated polymerizable carboxylic acids or ester or anhydrides thereof. Suitable polymers include those described in U.S.

Pat. No. 3,590,076 (Heintzelman et al.) that is incorporated herein by reference in its entirety. The number average molecular weight of the solid polymer is generally from about 300 to about 5000. Mixtures of these solid polymers can be used.

More particularly, the solid polymer is a polyolefin derived from one or more o-olefin monomers, preferably each having 2 to 8 carbon atoms. Ethylene and/or propylene are especially preferred monomers.

Suitable ethylenically unsaturated polymerizable carboxylic acid monomers are those having from 3 to 12 carbon atoms, and preferably from 4 to 5 carbon atoms. Monomers that are dicarboxylic acids and anhydrides thereof are preferred. These include maleic acid, ethyl maleic acid, propyl maleic acid, isopropyl maleic acid, fulmaric acid, methylene malonic acid, glutaconic acid, itaconic acid, methyl itaconic acid, mesaconic acid, and citraconic acid and their mixtures, as well as the corresponding esters, anhydrides, and mixtures of such acids, esters and anhydrides. Isopropyl maleic acid, esters and anhydrides therefore are especially preferred.

Suitable Component (a) polymers can also be represented by the following Structure (IV):

(IV)

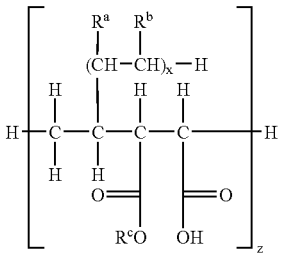

wherein $R^a$ and $R^b$ independently represent hydrogen or a substituted or unsubstituted alkyl group having 1 to 10 carbon atoms (such as methyl, ethyl, iso-propyl, n-propyl, n-hexyl, t-butyl, and others readily apparent to one skilled in the art). Preferably, $R^a$ and $R^b$ independently represent hydrogen or a substituted or unsubstituted alkyl groups having 1 to 5 carbon atoms.

$R^c$ is hydrogen or a substituted or unsubstituted alkyl group having 1 to 3 carbon atoms (such as methyl, ethyl, and iso-propyl), x represents a number of from 9 to 75, and "z" is a number of from 5 to 20.

In preferred embodiments, $R^a$ and $R^b$ are independently methyl or hydrogen, $R^c$ is hydrogen or methyl, "x" is from 3 to 15, and z is from 5 to 14.

For example, Component (a) can be a maleic anhydride polyethylene, maleic acid anhydride polypropylene, isopropylmaleate polyethylene, or iso-propylmaleate polypropylene graft copolymer.

A particularly preferred solid polymer commercially available under the tradename CERAMER® 1608, is a polyolefin that is the reaction product of α-alkenes having more than 10 carbon atoms (preferably about 30 carbon atoms) with maleic anhydride and mono-isopropyl maleate and exhibits a melting point of 78° C. (172° F.). Additional information on this material can be found at the website for CERAMER® 1608:

<http://www.bakerhughes.com/bakerpetrolite/polymers/olefin_maleic_polymers.htm>.

CERAMER® 1608 polyolefin can be characterized by a molecular weight (gel permeation chromatography) of about 700, an acid number (BWM 3.01A) of 160, a saponification number (BWM 3.01A) of 212 and a penetration index at 25° C. (ASTM 1321) of 3. The molar ratio of α-olefin monomer unit to isopropyl maleate monomer unit in the copolymer is about 1:1. Some units of isopropyl maleate and/or maleic acid anhydride may further be grafted onto the copolymer backbone. Increasing the amount of acid (isopropyl maleate) favors formation of graft copolymers.

Component (b) is a branched α-olefin polymer or mixtures thereof. This branched hydrocarbon typically has a number average molecular weight (as measured by vapor pressure osmometry) of at least 300, preferably at least 400, and more preferably at least 500. It typically has a number average molecular weight of no more than 10,000, preferably no more than 5,000, and more preferably no more than 3,000, although the molecular weight can be outside of these ranges. The branched hydrocarbon typically has a melting point (for crystalline materials) or a softening point (for amorphous or semi-crystalline materials) of at least 30° C., preferably at least 35° C., and more preferably at least 50° C., and typically has a melting point or softening point of no more than 120° C., preferably no more than 110° C., and more preferably no more than 100° C., although the melting point can be outside of these ranges. The degree of branching (or average number of branches per molecule) in the branched hydrocarbon typically is from about 4 to about 5, and typically is no more than about 15, and preferably no more than about 10, although the degree of branching can be outside of these ranges. The branched hydrocarbon can be saturated or unsaturated, and can include cyclic moieties. In addition, oxidized hydrocarbons, such as polyethylene-based oxidized materials and microcrystalline-based oxidized materials can be used, as can unsaturated and branched hydrocarbon-like molecules using as a core cyclic compounds or dendrimer or arborols.

Also suitable are homopolymers and copolymers prepared from monomers of the formula $R^dCH{=}CH_2$ wherein $R^d$ is a substituted or unsubstituted alkyl group having from 1 to 18 carbon atoms, and preferably from 3 to 12 carbon atoms, although the number of carbon atoms can be outside of these ranges. The polymerized α-olefin used as component (b) in this invention is also known as an olefin-derived hydrocarbon polymer or catalytically polymerized α-olefin.

The component (b) branched α-olefin polymers can be represented by the following Structure (V):

(V)

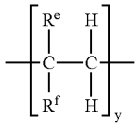

where $R^e$ is a substituted or unsubstituted alkyl group having 4 to 50 carbon atoms and preferably 18 to 40 carbon atoms. These alkyl groups can be branched or unbranched. $R^f$ is hydrogen or a substituted or unsubstituted alkyl group having 6 to 50 carbon atoms. Preferably $R^f$ is hydrogen. In addition, "y" is a number of from 10 to 500.

These polymers can be prepared using for example, using the polymerization process described in U.S. Pat. No. 4,060,569 (Woods et al.) that is incorporated herein by reference. The α-olefin monomer(s) is polymerized in the presence of a free radical catalyst such as a peroxide or hydroperoxide. The molar ratio of free radical catalyst to α-olefin is from about 0.005 to about 0.35. The polymerization is carried out at low pressures sufficient to prevent vaporization of the free radical or α-olefin. The polymerization temperature is typically set such that the free radical catalyst would have a half-life between 0.5 and 3 hours (for example in a range from about 40° C. to about 250° C.).

The poly(α-olefins) used as component (b) are characterized in that they have higher viscosities and greater hardness but lower melting and congealing points than the α-olefin monomers from which they are derived. This is in contrast to typical hydrocarbon polymers that have higher viscosities and greater hardness but also higher melting and congealing points than the hydrocarbon monomers from which they are derived. Because of their relatively low molecular weights, the polymerized α-olefins are also known as polymeric waxes or polymerized α-olefin waxes.

Some polymerized α-olefins are commercially available for example, from the Baker Petrolite Corporation (Sugar Land, Tex.) under the tradename VYBAR®, that is available in solid (for example VYBAR® 103, VYBAR® 260) or liquid (for example VYBAR® 825) form. The use of the solid polymer is preferred.

VYBAR® is a polymerized a-olefin prepared by polymerizing α-olefins under free radical conditions at low pressures. The polymers are unique in that although α-olefin polymers generally have higher molecular weight, greater viscosity and greater hardness than the starting monomer, VYBAR® polymers generally have lower melting points and congealing points than the starting monomer. The monomers employed are primarily α-olefins of the formula where $R^e$ is an alkyl group having from 4 to 50 carbon atoms or is a mixture of α-olefins, vinylidene compounds, internal olefins, and saturated hydrocarbons. Because α-olefins are primarily employed as the monomers used to prepare these polymers, this term is often used to indicate both α-olefins and mixtures of various combinations of α-olefins, vinylidenes, internal olefins, and saturated hydrocarbons.

Examples of suitable branched hydrocarbons include VYBAR® 253, a poly(α-olefin) having a number average molecular weight of about 520, a softening point of about 67° C. (measured by ASTM method D36) and a degree of branching of from about 5 to about 10. This polymer is based on an ethylene structure having pendant hydrocarbon side chains and is also referred to as a poly(α-olefin) or a poly(1-alkene). Also suitable for use in this invention are VYBAR® 103 having a number average molecular weight of about 4400, VYBAR® 260 having a number average molecular weight of about 2,600, and the VYBAR® X-series polymers, such as X-6044, X-6059, and X-6028. Also useful are oxidized hydrocarbons such as those available from Baker Petrolite Corp. as polyethylene-based oxidized materials and microcrystalline-based oxidized materials, such as the CARDIS® and PETRONAUBA® materials.

A particularly preferred branched polyolefin is VYBAR® 103, CAS [68527-08-2] that is described as alkenes, macromonomers with greater than 10 carbon atoms that are α-polymerized and having a softening point of 74° C. (165.2° F.). Additional information for this material can be found at the website for VYBAR® 103:

<http://www.bakerhughes.com/bakerpetrolite/polymers/vybar/index.htm>.

The optional but preferred third component (c) in the protective layer is an "additional" wax that is any suitable wax that will form a hydrophobic coating and can be blended with the branched α-olefin. Thus, animal, vegetable, mineral and synthetic waxes may be employed, as may be mixtures thereof Generally speaking, a wax is a substance that is a solid at ambient temperature and that has a low viscosity at just above its melting point. Typically, a wax is a substance having the following properties: (1) crystalline to microcrystalline structure, (2) capacity to acquire gloss when rubbed (as distinct from greases), (3) capacity to produce pastes or gels with suitable solvents or when mixed with other waxes, (4) low viscosity at just above the melting point. See *Grant & Hackh's Chemical Dictionary* (5th Edition), page 628, hereby incorporated by reference. Waxes differ from fats in that fats are esters of trihydric lower alcohols.

The following components are illustrative types of both synthetically prepared and naturally occurring waxes that may be employed as component (c):

Useful mineral waxes include but are not limited to paraffin (26–30 carbon atom aliphatic hydrocarbons), microcrystalline waxes (41–50 carbon atom branched chain hydrocarbons), oxidized microcrystalline waxes (hydrocarbons, esters, fatty acids), montan (waxing acids, alcohols, ester, and ketones), Hoechst waxes (oxidized montan wax), and ozokerite waxes (high molecular weight aliphatic and alkenyl hydrocarbons).

Useful vegetable waxes include but are not limited to, carnauba wax (complex alcohols and hydrocarbons), esparto, flax, and sugarcane waxes (fatty acid esters, aldehydes, esters, alcohols, hydrocarbons), and candelilla waxes (hydrocarbons, acids, esters, alcohols, and lactones).

Useful animal waxes include but are not limited to beeswax.

Useful synthetic waxes include but are not limited to polyolefins derived from one or more olefins.

One preferred additional wax is the fully saturated homopolymer of a low molecular weight polyethylene (such as a low molecular weight polyolefin), or copolymers of various alkene monomers that form polymers with a molecular weight at or below 3,000, a melting point below 130° C., and low melt viscosities. Applicable waxes could include POLYWAX® that is available from Baker Petrolite Corp.

In preferred embodiments, component (c) is a microcrystalline wax, carnauba wax, petronauba wax, paraffin wax, candelilla wax, or a linear low molecular weight polyethylene.

POLYWAX® is a linear polyethylene wax. A particularly preferred wax is POLYWAX® 400, CAS [9002-88-4], described as polyethylene homopolymer with weight average molecular weight of about 450 and a melting point of 81° C. (177.8° F.). Additional information on this material can be found at the website for POLYWAX® 400:

<http/www.bakerhughes.com/bakerpetrolite/polymers/ethylene_homopolymers.htm>.

The total amount of components (a), (b), and optionally (c) that is present in the protective layer is generally of from about 0.1 to about 2.5 g/m$^2$ and preferably from about 0.15 to about 1 g/m$^2$, with or without a binder. Preferably, all three components are used in the protective layer.

The amount of component (a) is at least 0.01 g/m$^2$ and up to 1 g/m$^2$. In addition, the weight ratio of component (a) to component (b) is from about 1:10 to about 10:1. When component (c) is present, the weight ratio of component (a) to component (c) is from about 1:10 to about 10:1, and the weight ratio of component (b) to component (c) is from about 1:10 to about 10:1.

One or more binders may also be used in the protective layer. In preferred embodiments, polymeric thermoplastic binders are employed. Examples of such materials include but are not limited to, poly(styrene-co-acrylonitrile) (for example a 70/30 monomer weight ratio), poly(vinyl alcohol-co-butyral) (available commercially as BUTVAR® B-76 or PIOLOFORM® BS-18), poly(vinyl alcohol-co-acetal), poly (vinyl alcohol-co-benzal), polystyrene, poly(vinyl acetate), cellulose acetate butyrate(available commercially as CAB 171-15S), cellulose acetate propionate, cellulose acetate, ethyl cellulose, cellulose triacetate, poly(methyl methacrylate), and copolymers derived from methyl methacrylate. In preferred embodiments of the invention, the binder is CAB 171-15S or PIOLOFORM® BS-18.

The amount of the binder(s) present in the protective layer is generally in an amount of from about 50 to about 95 weight % of the total protective layer.

The protective layer can also contain matting agents such as starch, titanium dioxide, zinc oxide, silica, calcium carbonate, and polymeric beads including beads of the type described in U.S. Pat. No. 2,992,101 (Jelley et al.) and U.S. Pat. No. 2,701,245 (Lynn). The matting agents can be composed of any useful material and may have a size in relation to the protective layer thickness that enables them to protrude through the outer surface of the protective layer, as described for example, in U.S. Pat. No. 5,536,696 (Horsten et al.). If matting agents are present, they generally comprise from about 0.2 to about 10 dry weight % of the protective layer.

Polymeric fluorinated surfactants may also be useful in the protective layer as described in U.S. Pat. No. 5,468,603 (Kub).

In addition, nanometer size particles can be used as reinforcing agents in the protective layer. Such particles are described in for example, copending and commonly assigned U.S. Patent Application Publication 2004/0198602 (Pham,) that is incorporated herein by reference.

In general, the outermost protective layer has a dry thickness of from about 0.1 to about 10 mμ. Preferably the protective layer dry thickness is from about 1 to about 6 mμ.

Thermographic Formulations and Constructions

An organic-based formulation for the thermographic emulsion layer(s) can be prepared by dissolving and dispersing the binder, the source of non-photosensitive silver ions, the reducing agent, and optional addenda in an organic solvent, such as toluene, 2-butanone(methyl ethyl ketone), acetone, or tetrahydrofuran (or mixtures thereof).

Alternatively, the desired imaging components can be formulated with a hydrophilic binder (such as gelatin, a gelatin-derivative, or a latex) in water or water-organic solvent mixtures to provide aqueous-based coating formulations.

The thermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic and organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

The thermographic materials can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), polythiophenes as described in U.S. Pat. No. 5,747,412 (Leenders et al.), electro-conductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al.), and in copending and commonly assigned U.S. Ser. No. 10/930,428 (filed Aug. 31, 2004 by Ludemann, LaBelle, Koestner, Hefley, Bhave, Geisler, and Philip) and U.S. Ser. No. 10/930,438 (filed Aug. 31, 2004 by Ludemann, LaBelle, Philip, Koestener, and Bhave). All of the above patents and patent applications are incorporated herein by reference.

In addition to the conductive particles described above, other conductive materials may be present in either the buried conductive backside layer or other backside layers. Such compositions include fluorochemicals that are described in U.S. Pat. No. 6,699,648 (Sakizadeh et al.) and U.S. Pat. No. 6,762,013 (Sakizadeh et al.). Both of these patents are incorporated herein by reference.

The thermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.), incorporated herein by reference.

The thermographic materials can be constructed of two or more layers on the imaging side of the support. Two-layer materials would include a single imaging layer and an outermost protective layer. The single imaging layer would contain the non-photosensitive source of reducible silver ions, the reducing agent, the binder, as well as optional materials such as toners, coating aids, and other adjuvants.

Three-layer constructions comprising two imaging layer coatings containing the ingredients and an outermost protective are generally found on the frontside of the materials.

Layers to promote adhesion of one layer to another in thermographic materials are also known, as described in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), U.S. Pat. No. 6,420,102 (Bauer et al.), and U.S. Pat. No. 6,746,831 (Hunt), all incorporated herein by reference.

Layer formulations described herein can be coated by various coating procedures including wire wound rod coating, dip coating, air knife coating, curtain coating, slide coating, or extrusion coating using hoppers of the type described in U.S. Pat. No. 2,681,294 (Beguin). The formulations can be coated one at a time, or two or more formulations can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. The coated materials can be dried in forced air at a temperature of from about 20° C. to about 100° C. It is preferred that the thickness of the layer be selected to provide maximum image densities greater than about 0.2, and more preferably, from about 0.5 to 5.0 or more, as measured by an X-rite Model 361/V Densitometer equipped with 301 Visual Optics.

When the layers are coated simultaneously using various coating techniques, a "carrier" layer formulation comprising a single-phase mixture of the two or more polymers described above may be used as described in U.S. Pat. No. 6,436,622 (Geisier), incorporated herein by reference.

Mottle and other surface anomalies can be reduced in the materials of this invention by incorporation of a fluorinated polymer as described in U.S. Pat. No. 5,532,121 (Yonkoski et al.) or by using particular drying techniques as described in U.S. Pat. No. 5,621,983 (Ludemann et al.).

Preferably, two or more layers are applied to a film support using slide coating techniques by coating the first layer on top of the second layer while the second layer is still wet using the same or different coating fluids or solvent mixtures.

While the first and second layers can be coated on one side of the film support, manufacturing methods can also include forming on the opposing or backside of said polymeric support, one or more additional layers, including an outermost protective layer.

It is preferred that the conductive layers be disposed on the backside of the support and especially where it is buried or underneath one or more other layers such as backside protective layer(s). Such backside conductive layers typically have a water electrode resistivity (WER) of about $10^5$ to about $10^{12}$ ohm/sq. This technique is described in R. A. Elder *Resistivity Measurements on Buried Conductive Layers,* EOS/ESD Symposium Proceedings, Lake Buena Vista, Fla., 1990, pp. 251–254, [EOS/ESD stands for Electrical Overstress/Electrostatic Discharge].

Preferably, the backside conductive layer comprises non-acicular metal antimonate particles composed of $ZnSb_2O_6$. Several conductive metal antimonates are commercially available from Nissan Chemical Industry, Ltd. (Japan) under the tradename CELNAX® 401M. The metal antimonate particles in the conductive layer are predominately (more than 50% by weight of total particles) in the form of non-acicular particles as opposed to "acicular" particles. By "non-acicular" particles is meant not needlelike, that is, not acicular. Preferably the metal antimonate is of $ZnSb_2O_6$.

The conductive layer is generally coated out of one or more miscible organic solvents including, but not limited to, methyl ethyl ketone (2-butanone, MEK), acetone, toluene, tetrahydrofuran, ethyl acetate, ethanol, methanol, or any mixture of any two or more of these solvents. Alternatively, the conductive layer can be coated using aqueous solvents and hydrophilic binder or a polymer latex.

As noted above, the conductive layer also includes one or more binder materials that are usually polymers that are generally soluble or dispersible in the organic solvents noted above. The polyvinyl acetals, polyesters, cellulosic ester polymers, and vinyl polymers such as polyvinyl acetate and polyvinyl chloride are particularly preferred, and the polyvinyl acetals, polyesters, and cellulosic ester polymers are more preferred.

Imaging/Development

The direct thermographic materials can be imaged in any suitable manner consistent with the type of material using any suitable source of thermal energy. The image may be "written" simultaneously with development at a suitable temperature using a thermal stylus, a thermal print-head, or a laser, or by heating the material as it is moved while in contact with a heat absorbing material. The thermographic materials may include a dye (such as an IR-absorbing dye) to facilitate direct development by exposure to laser radiation. The dye converts absorbed radiation to heat.

Use as a Photomask

The direct thermographic materials are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials affords a visible image. The thermographic materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the thermographic material provides an image in the imageable material. This method is particularly useful where the imageable medium comprises a printing plate and the thermographic material serves as an imagesetting film.

Thus, the present invention provides a method for the formation of a visible image (usually a black-and-white image) by thermal imaging of the inventive direct thermographic material. This image may be useful for medical diagnosis.

The following examples are provided to illustrate the practice of the present invention and the invention is not meant to be limited thereby.

Materials and Methods for the Experiments and Examples:

All materials used in the following examples are readily available from standard commercial sources, such as Aldrich Chemical Co. (Milwaukee Wis.) unless otherwise specified. All percentages are by weight unless otherwise indicated.

ALBACAR 5970 is a 1.9 μm precipitated calcium carbonate. It is available from Specialty Minerals, Inc. (Bethlehem, Pa.).

BUTVAR® B-79 is a polyvinyl butyral resin available from Solutia, Inc. (St. Louis, Mo.).

CAB 171-15S and CAB 381-20 are cellulose acetate butyrate resins available from Eastman Chemical Co. (Kingsport, Tenn.).

CELNAX® CX-Z401M is a 40% organosol dispersion of non-acicular zinc antimonate particles in methanol. It was obtained from Nissan Chemical America Corporation (Houston, Tex.).

MEK is methyl ethyl ketone (or 2-butanone).

PARALOID® A-21 is an acrylic copolymer available from Rohm and Haas (Philadelphia, Pa.).

PIOLOFORM® BL-16 and BS-18 are polyvinyl butyral resins available from Wacker Polymer Systems (Adrian, Mich.).

PS512-KG is an aminopropyldimethyl terminated polydimethylsiloxane available from United Chemical Technologies (Bristol, Pa.).

VITEL® PE 5833B is a polyester resin available from Bostik, Inc. (Middleton, Mass.).

VITEL® PE7915 is a copolyester resin and is available from Bostik, (Middleton, Mass.).

Optical Densities were measured using an X-Rite Model 361T Densitometer (X-Rite Incorporated, Grandville, Mich.).

Color measurement such as L, a*, and b* values were measured by HunterLab UltraScan (Hunter Associates Laboratory, Inc., Reston, Va.). These values were determined using CIELAB standards described above.

Comparative Compounds:

The following comparative compounds were used:

(C-1)

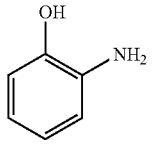

(C-2)

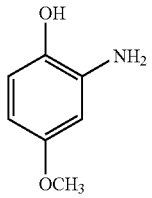

(C-3)

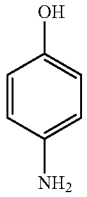

(C-4)

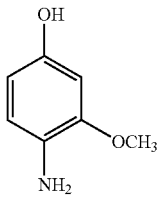

(C-5)

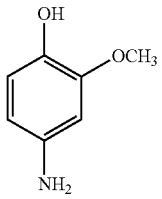

-continued (C-6)

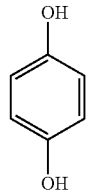

(C-7)

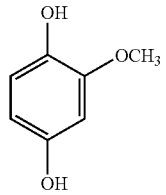

The following examples demonstrate the use of phenolic reducing agents in thermographic materials according to this invention.

EXAMPLE 1

Preparation of Thermographic Coatings

Preparation of Primer Layer

A solution of 15% by weight of VITEL® 7915 in MEK was coated onto a 7 mil (178 μm) polyethylene terephthalate support and dried in an oven at 85° C. for 4 minutes to form a primer layer for coating of the thermographic image-forming layer.

Silver Soap Homogenate Formulation:

A silver soap thermographic homogenate formulation was prepared with the following components.

| | |
|---|---|
| MEK | 75.5 parts |
| Silver Behenate | 24.0 parts |
| PIOLOFORM ® BL-16 | 0.5 parts |

The materials were mixed and homogenized by passing twice through a homogenizer at 5000 psi (352 kg/cm$^2$). The materials were cooled between the two passes.

Thermographic Emulsion Formulation:

To 104 g of the silver behenate homogenate at. 24.5% solids was added 129.7 g of MEK. The resulting dispersion was stirred for 15 minutes at 1300 rpm. To this dispersion was added 4 g of 1-(2H)-phthalazinone. Stirring for 30 minutes was followed by addition of 62.3 g of BUTVAR® B-79. Stirring was maintained for an additional 60 minutes.

The compounds (0.038 mole) shown below in TABLE I were evaluated as developers. The compounds were added to 300 g of the above solution and mixed for 30 minutes.

Preparation of Protective Overcoat Solution

A protective overcoat formulation was prepared by mixing the following materials:

| | |
|---|---|
| MEK | 64.94 parts |
| CAB 381-20 | 12.11 parts |
| PARALOID ® A-21 | 1.65 parts |
| SYLOID ® 74X6000 | 0.14 parts |
| PS512-KG | 0.39 parts |
| ALBACAR 5970 | 0.93 parts in 19.98 g of MEK |

Each of the thermographic emulsion layer and protective layer formulations were coated onto the primed 7 mil (178 μm) blue tinted polyethylene terephthalate support. A conventional, laboratory scale, dual-knife coater was used. Samples were dried in an oven at 185° F. (85° C.) for 7 minutes. The coating weight of the thermographic emulsion layer was 1.53 g/ft$^2$ (16.46 g/m$^2$). The coating weight of the protective layer was 0.25 g/ft$^2$ (2.69 g/m$^2$).

The resulting thermographic sheets were imaged with an AGFA DryStar™ Model 2000 printer. A test pattern was used. All samples gave several levels of gray and a black image.

The results, shown below in TABLE I demonstrate the following:

ortho-Amino phenol compounds having a calculated aqueous deprotonation energy of less than 307 kcal/mol and preferably less than 305 kcal/mol along with a calculated anion HOMO energy more negative than −4.17 eV and preferably more negative than −4.34 eV provided thermographic materials with low Dmin and high Dmax. A comparative thermographic material incorporating the parent compound, ortho-amino phenol (Sample 1-1, Compound C-1) had an unacceptably high Dmin. Comparative compound C-2 that has an electron releasing group on the benzene ring would be expected to behave similarly to ortho-amino phenol.

para-Amino phenol compounds having a calculated aqueous deprotonation energy of less than 310 kcal/mol and preferably less than 309 kcal/mol along with a calculated anion HOMO energy more negative than −4.18 eV provided thermographic materials with low Dmin and high Dmax. A comparative thermographic material incorporating the parent compound, para-amino phenol (Sample 1-12, Compound C-3) had an unacceptably high Dmin. Comparative compounds C-4, and C-5 that have electron releasing groups on the benzene ring would be expected to behave similarly to para-amino phenol.

Hydroquinones having a calculated aqueous deprotonation energy of less than 311 kcal/mol and preferably less than 303 kcal/mol along with a calculated anion HOMO energy more negative than −4.06 eV and preferably more negative than −4.28 eV provided thermographic materials with low Dmin and high Dmax. A comparative thermographic material incorporating the parent compound, hydroquinone (Sample 1-17, Compound C-6) had an unacceptably low Dmax. Comparative compound C-7 that has an electron releasing group on the benzene ring would be expected to behave similarly to hydroquinone.

TABLE I

| Sample | Compound | Dmin | Dmax | Calculated Aqueous Deprotonation Energy [kcal/mol] | Calculated Anion HOMO Energy [eV] |
|---|---|---|---|---|---|
| ortho-Amino-Phenols | | | | | |
| 1-1 | C-1 | 0.39 | 2.77 | 307 | −4.13 |
| 1-2 | C-2 | — | — | 308 | −4.17 |
| 1-3 | RA-1 | 0.18 | 2.33 | 298 | −4.61 |
| 1-4 | RA-2 | 0.20 | 3.82 | 305 | −4.37 |
| 1-5 | RA-3 | 0.17 | 2.64 | 301 | −4.53 |
| 1-6 | RA-4 | 0.17 | 2.50 | 306 | −4.34 |
| 1-7 | RA-5 | 0.17 | 3.09 | 298 | −4.63 |
| 1-8 | RA-6 | 0.25 | 2.80 | 299 | −4.53 |
| 1-9 | RA-7 | 0.24 | 4.29 | 294 | −4.78 |

TABLE I-continued

| Sample | Compound | Dmin | Dmax | Calculated Aqueous Deprotonation Energy [kcal/mol] | Calculated Anion HOMO Energy [eV] |
|---|---|---|---|---|---|
| 1-10 | RA-8 | 0.25 | 2.64 | 298 | −4.69 |
| 1-11 | RA-9 | 0.24 | 2.31 | 302 | −4.52 |
| Para-Amino-Phenols | | | | | |
| 1-12 | C-3 | 0.44 | 2.57 | 313 | −3.62 |
| 1-13 | C-4 | — | — | 310 | −4.33 |
| 1-14 | C-5 | — | — | 312 | −4.26 |
| 1-15 | RA-10 | 0.22 | 2.21 | 297 | −4.44 |
| 1-16 | RA-11 | 0.19 | 0.37 | 309 | −4.18 |
| Hydro-quinones | | | | | |
| 1-17 | C-6 | 0.17 | 1.52 | 311 | −4.06 |
| 1-18 | C-7 | — | — | 311 | −4.04 |
| 1-19 | RA-12 | 0.22 | 3.12 | 294 | −4.93 |
| 1-20 | RA-13 | 0.26 | 3.47 | 302 | −4.43 |
| 1-21 | RA-14 | 0.25 | 3.36 | 303 | −4.38 |
| 1-22 | RA-15 | 0.26 | 3.71 | 299 | −4.70 |
| 1-23 | RA-16 | 0.28 | 3.82 | 293 | −4.86 |
| 1-24 | RA-17 | 0.25 | 2.98 | 303 | −4.54 |

The invention has been described in detail with particular reference to certain preferred embodiments thereof, but it will be understood that variations and modifications can be effected within the spirit and scope of the invention.

The invention claimed is:

1. A black and white non-photosensitive direct thermographic material comprising a support and on one or both sides thereof, one or more thermally sensitive imaging layers having in reactive association, a non-photosensitive source of reducible silver ions and an ortho-amino-phenol, para-amino-phenol, or hydroquinone compound reducing agent for said reducible silver ions, wherein said ortho-amino phenol compounds have a calculated aqueous deprotonation energy of less than 307 kcal/mol and a calculated anion HOMO energy more negative than −4.17 eV, said para-amino phenol compounds have a calculated aqueous deprotonation energy of less than 310 kcal/mol and a calculated anion HOMO energy more negative than −4.18 eV, and said hydroquinones have a calculated aqueous deprotonation energy of less than 311 kcal/mol and a calculated anion HOMO energy more negative than −4.06 eV.

2. The non-photosensitive direct thermographic material of claim 1, wherein said ortho-amino phenol compounds have a calculated aqueous deprotonation energy of less than 305 kcal/mol and a calculated anion HOMO energy more negative than −4.34 eV.

3. The non-photosensitive direct thermographic material of claim 1, wherein said para-amino phenol compounds have a calculated aqueous deprotonation energy of less than 310 kcal/mol and a calculated anion HOMO energy more negative than −4.18 eV.

4. The non-photosensitive direct thermographic material of claim 1, wherein said hydroquinones have a calculated aqueous deprotonation energy of less than 303 kcal/mol and a calculated anion HOMO energy more negative than −4.28 eV.

5. The non-photosensitive direct thermal material of claim 1 wherein said reducing agent comprises an ortho-amino-phenol, para-amino-phenol, or hydroquinone compound can be represented by the following structures (I), (II), and (III):

(I)

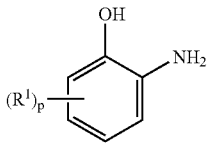

(II)

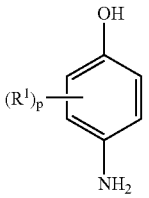

(III)

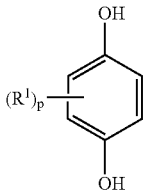

wherein $R^1$ represents the same or different electron-withdrawing groups and p is 1 or 2.

6. The material of claim 5 wherein said electron-withdrawing group is a cyano, nitro, keto, aldehyde, perhaloalkyl, alkylsulfonyl, carboxylic acid, carboxamide or carboxylic ester group.

7. The non-photosensitive direct thermal material of claim 1 wherein said reducing agent comprises at least one of the following compounds (RA-1) to (RA-17):

(RA-1)

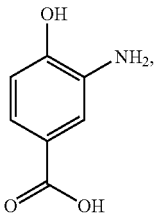

(RA-2)

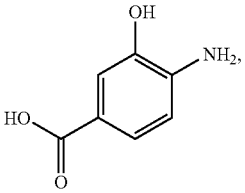

(RA-3)

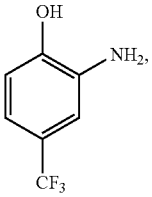

-continued (RA-4)

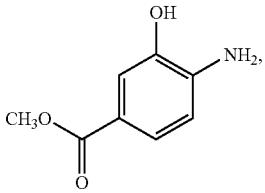

(RA-5)

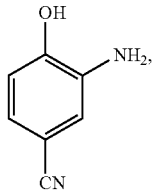

(RA-6)

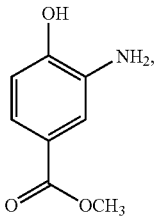

(RA-7)

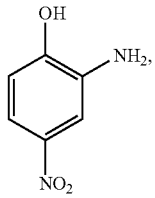

(RA-8)

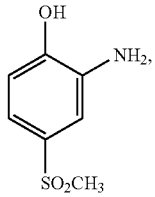

(RA-9)

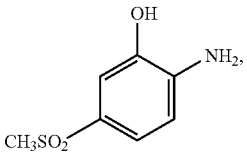

(RA-10)

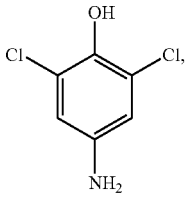

(RA-11)

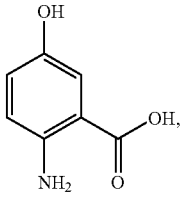

-continued (RA-12)

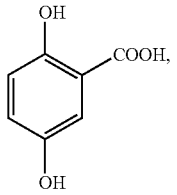

(RA-13)

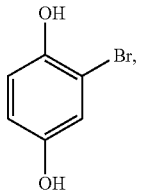

(RA-14)

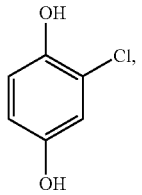

(RA-15)

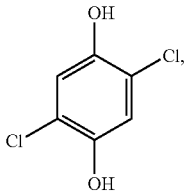

(RA-16)

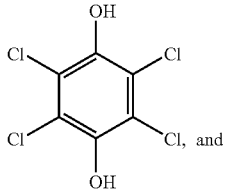

(RA-17)

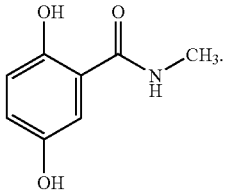

8. The material of claim 1 wherein said ortho-amino-phenol, para-amino-phenol, or hydroquinone compound reducing agent is present in an amount of at least 0.03 mol/mol of total silver.

9. The material of claim 1 wherein said ortho-amino-phenol, para-amino-phenol, or hydroquinone compound reducing agent is present in an amount of from about 0.05 to about 2.0 mol/mol of total silver.

10. The material of claim 1 wherein said reducing agent and said non-photosensitive source of reducible silver ions are in the same thermally sensitive imaging layer.

11. The material of claim 1 wherein said non-photosensitive source of reducible silver ions includes one or more silver carboxylates, one of which is silver behenate.

12. The material of claim 11 wherein said non-photosensitive source of reducible silver ions includes highly crystalline silver behenate.

13. The material of claim 1 wherein said one or more thermally sensitive imaging layers further comprises one or more aliphatic or aromatic polycarboxylic acids.

14. The material of claim 1 further comprising a non-thermally sensitive protective overcoat disposed on said one or more thermally sensitive imaging layers.

15. The material of claim 14 wherein said overcoat layer is the outermost layer of said material and comprises matte particles and all three of the following components (a), (b), and (c):

(a) a polyolefin solid polymer having a molecular weight of about 700, an acid number of 160, a saponification number of 212, a penetration index at 25° C. of 3, a melting point of 78° C., and that is the reaction product of α-olefin with maleic anhydride and mono-isopropyl maleate, (b) a branched α-olefin polymer having a number average molecular weight of about 4400, a softening point of 74° C., and (c) a linear polyethylene wax having a weight average molecular weight of about 450 and a melting point of 81° C., wherein the weight ratio of component (a) to component (b) is from about 1:2 to about 2:1, the weight ratio of said component (a) to component (c) is from about 1:2 to about 2:1, and the weight ratio of component (b) to component (c) is from about 1:2 to about 2:1, and component (a) is present in an amount of from about 0.01 to about 1 $g/m^2$.

16. The material of claim 1 wherein said support is transparent.

17. The material of claim 1 further comprising a conductive layer on the backside of said support.

18. The material of claim 17 wherein said conductive layer comprises non-acicular metal antimonate particles composed of $ZnSb_2O_6$.

19. The material of claim 1 further comprising a toner.

20. A method comprising imaging the direct thermographic material of claim 1 with a thermal imaging source to provide a visible image.

21. The method of claim 20 wherein said imaging is carried out using a thermal print-head when said thermographic material is moved in contact with and relative to said thermal print-head.

22. The method of claim 20 wherein said visible image is used for medical diagnostic purposes.

* * * * *